US005318235A

United States Patent [19]

Sato

[11] Patent Number: 5,318,235

[45] Date of Patent: Jun. 7, 1994

[54] CORES FOR COMPRESSED CORE WOUND PAPER PRODUCTS

[75] Inventor: Jay K. Sato, West Chester, Ohio

[73] Assignee: The Procter & Gamble Company, Cincinnati, Ohio

[21] Appl. No.: 986,645

[22] Filed: Dec. 8, 1992

[51] Int. Cl.[5] ..... B32B 9/00

[52] U.S. Cl. ..... 242/72 R; 242/54 R; 242/55.2; 242/79; 206/389

[58] Field of Search ..... 242/55.2, 79, 54, 72; 206/389

[56] References Cited

U.S. PATENT DOCUMENTS

| | | | |
|---|---|---|---|
| 347,416 | 8/1886 | Buckingham . | |
| 401,233 | 4/1889 | Wheeler . | |
| 972,668 | 10/1910 | Wheeler . | |
| 1,005,787 | 10/1911 | Sibley . | |
| 2,571,321 | 10/1951 | Wettley | 242/55.2 |
| 2,639,099 | 5/1953 | Gough, Jr. | 242/55.2 |
| 2,659,543 | 11/1953 | Guyer | 242/72 |
| 2,889,121 | 6/1959 | Heinle | 242/55.2 |
| 3,082,931 | 3/1963 | Greenwell et al. | 229/37 |
| 3,145,940 | 8/1964 | Henry | 242/55.2 |
| 3,170,652 | 2/1965 | Kennedy | 242/55.2 |
| 3,224,700 | 12/1965 | Heinle | 242/55.53 |
| 3,258,216 | 6/1966 | Wren | 242/55.53 |
| 3,433,355 | 3/1969 | Smith | 206/59 |
| 3,601,328 | 8/1971 | McClung | 242/55.2 |
| 3,630,430 | 12/1971 | Struble | 229/16 B |
| 4,120,323 | 10/1978 | Saul | 138/129 |
| 4,660,781 | 4/1987 | Hazard | 242/55.2 |
| 4,762,061 | 8/1988 | Watanabe et al. | 100/35 |
| 4,886,167 | 12/1989 | Dearwester | 206/389 |
| 4,907,696 | 3/1990 | DeCoste, Jr. | 206/411 |
| 4,909,388 | 3/1990 | Watanabe | 206/410 |
| 5,027,582 | 7/1991 | Dearwester | 53/399 |
| 5,255,864 | 10/1993 | Lahaussois | 242/68.5 |

FOREIGN PATENT DOCUMENTS

| | | |
|---|---|---|
| WO92/11196 | 7/1992 | PCT Int'l Appl. . |
| 709363 | 5/1954 | United Kingdom . |

*Primary Examiner*—Patrick J. Ryan
*Assistant Examiner*—Kam F. Lee
*Attorney, Agent, or Firm*—Gerry S. Gressel; Larry L. Huston; Fredrick H. Braun

[57] ABSTRACT

A core for compressed core wound paper products such as toilet tissue and paper toweling is disclosed. The core is selectively cut and scored to form folding tab portions that fold radially inward when the core is in a generally flattened configuration. Upon rerounding of the core to a generally cylindrical configuration, the folding tab portions can be unfolded to form circular arcs conforming to the core inner and outer surfaces. The folding tab portions enable the core to reround to a generally cylindrical configuration that resists reflattening.

18 Claims, 3 Drawing Sheets

CORES FOR COMPRESSED CORE WOUND PAPER PRODUCTS

CROSS REFERENCE TO RELATED APPLICATION

This patent application cross-references and incorporates by reference the following patent application assigned to The Procter and Gamble Company and filed herewith: U.S. patent application Ser. No. 07/986,955 entitled Cores Providing Reduced Spindle Clearance for Care Wound Paper Products, filed on even date by Kenneth B. Buell and Donald D. Dearwester.

FIELD OF THE INVENTION

This invention is related to cores for core wound paper products, and particularly to cores having a flattened configuration prior to use and a rerounded configuration having a generally circular cross-section during use.

BACKGROUND OF THE INVENTION

Rolls of toilet paper and paper toweling typically comprise a paper product wound upon a hollow core. The roll is typically supported for rotation on a spindle which extends through the hollow core.

A preferred core shape for dispensing a paper product is a cylinder having a geometrically circular cross-section. A core with a circular cross-section freely rotates about the axis of the spindle and permits smooth, quiet dispensing of the paper product from the roll. However, a core having a hollow circular cross-section has a relatively large void space. It is desirable to reduce such void spaces to improve shipping and storage efficiencies.

One improvement to core wound paper products includes diametric compression of the roll, such that the core has a generally flattened configuration with reduced core void space. The flattened core configuration permits the core wound product to be shipped and stored more economically and in higher densities.

Several attempts have been made in the art to realize the benefits of compressed core wound paper products. Examples of compressed core wound paper products are disclosed in the following references: U.S. Pat. No. 401,233 issued Apr. 9, 1889, to Wheeler, U.S. Pat. No. 972,668 issued Oct. 11, 1910, to Wheeler; U.S. Pat. No. 1,005,787 issued Oct. 10, 1911, to Sibley; U.S. Pat. No. 4,762,061 issued Aug. 9, 1988, to Watanabe, U.S. Pat. No. 4,886,167 issued Dec. 12, 1989, to Dearwester, U.S. Pat. No. 4,909,388 issued Mar. 20, 1990, to Watanabe, U.S. Pat. No. 5,027,582 issued Jul. 2, 1991 to Dearwester; PCT International Publication Number WO 92/11196 Published Jul. 9, 1992, by Dearwester et al.; and G.B. Patent 709,363 issued May 19, 1954, to Samson.

While the compressed rolls taught in these references reduce hollow core void space, they suffer from one or more drawbacks. First, conventional cores can be unstable in the flattened configuration. This instability is characterized by the flattened core buckling and taking on a crescent shaped configuration when the forces compressing the roll are removed and rerounding forces are applied. This tendency to take on a crescent shaped configuration is also known as core inversion, and results in a closed core cross-section rather than an open cross-section. An inverted core having a closed cross section requires considerable effort on the part of the consumer to open the core cross section so that the core can be inserted onto a spindle.

Second, previously compressed cores can have unstable configurations when rerounded. A compressed core will generally have folding creases, vertices or other lines of weakening which cause such instability when the core is rerounded. Once the core is rerounded, radially inward directed forces on the roll can cause the core to reflatten along these same weakened lines. Reflattening of the core results in an undesirable non-circular core cross-section. A non-circular core cross-section results in wobble and noise as the roll is rotated on the spindle to dispense the paper product.

Third, previously compressed cores, when rerounded, often have a non-circular cross-section. Flattening of the core for compression creates flat core sections connected at folding creases or vertices. The rerounded core will have a polygonal cross-section having a relatively flat side corresponding to each folding crease or vertex. A rerounded core having a non-circular cross-section is undesirable for the reasons listed above.

Accordingly, it is an object of the present invention to provide a core which has a generally flattened configuration which resists core inversion upon rerounding. It is a further object of the present invention to provide a core having a rerounded configuration that resists reflattening. Yet a further object of the present invention is to provide a core having a rerounded, generally circular cross-section.

BRIEF SUMMARY OF THE INVENTION

The present invention comprises a core about which a paper product may be wound. The core is deformable from a generally cylindrical configuration to a generally flattened configuration. The core is selectively weakened by a series of cuts and scores, perforations, or creases that permit the core to be compressed to the generally flattened configuration and rerounded to a generally cylindrical configuration. The cuts and scores, perforations, or creases can be selectively positioned to promote core rerounding rather than core inversion, prevent reflattening once the core is rerounded, and provide a circular rather than polygonal core cross-section upon rerounding.

The core has inner and outer surfaces separated by a core wall thickness, and first and second longitudinally spaced apart core ends defining a longitudinal core axis and core length. Additionally, the core can have one or more folding tab portions at a given circumferential position. The folding tab portions at a given circumferential position have an aggregate length which is less than the core length.

The folding tab portions are foldable to extend radially inward of the core inner and outer surfaces when the core is in the generally flattened configuration. Each folding tab portion can unfold to form a circular arc generally conforming to the core surfaces when the core is in the generally rounded configuration, thereby providing a generally circular inner core surface upon rerounding of the core.

Each folding tab portion has longitudinally spaced apart first and second free edges. The free edges can be formed by circumferentially oriented cuts extending through the core wall thickness, and can be longitudinally spaced from the core ends. Each folding tab portion also has first and second selectively weakened attachments to the core.

The first and second selectively weakened attachments can comprise score lines on the core outer surface. Each of the selectively weakened attachments has a longitudinal length less than the core length. The first and second attachments are circumferentially spaced apart, and extend intermediate the first and second free edges.

A folding hinge can be positioned intermediate the first and second selectively weakened attachments to extend intermediate the first and second free edges. The folding hinge can comprise a score line on an inner surface of the folding tab portion. Each folding tab portion can comprise two circular arc panels pivotably connected by the folding hinge.

In one embodiment, the core can have a pair of substantially diametrically opposed folding tab portions folded radially inward when the core is in the substantially flattened configuration. The radially inward folded tab portions can act as springs to promote core rerounding rather than core inversion. The core can also have a pair of substantially diametrically opposed means for selectively weakening the core spaced substantially 90 degrees circumferentially from the folding tab portion folding hinges.

The means for selectively weakening the core can comprise a pair of substantially diametrically opposed score lines on the core inner surface, each score line extending longitudinally from the first core end to the second core end. The folding tab portions and the pair of diametrically opposed score lines on the core inner surface facilitate folding of the core to a flattened configuration having four generally circular segments. This orientation of folding tabs and score lines promotes rerounding of the core to a generally circular cross-section. The inner score lines extending the length of the core and the inner scored folding hinge provide core wall flexibility for core flattening. Inner scoring also preserves a load path for bending stresses on the outer surface of the core when the core is rerounded, thereby resisting reflattening of the core by diametrically opposed compressive forces.

BRIEF DESCRIPTION OF THE DRAWINGS

While the Specification concludes with claims particularly pointing out and distinctly claiming the present invention, it is believed the invention will be better understood from the following Specification taken in conjunction with the associated drawings wherein like parts are given the same reference numeral, and:

DETAILED DESCRIPTION OF THE INVENTION

Figure 1:
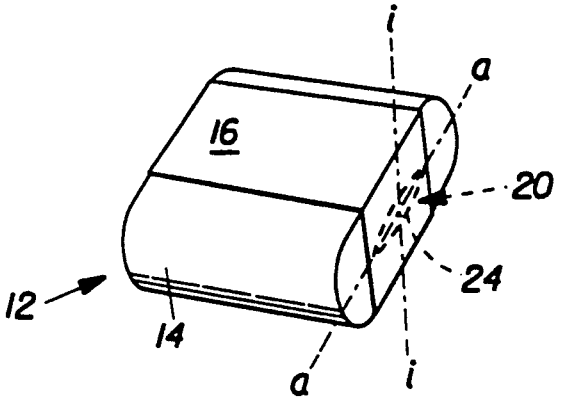
FIG. 1 is a perspective view of a flattened roll having a generally flattened core.

FIG. 1 illustrates a generally flattened roll 12 having a generally flattened core 20. A "core" as used herein refers to a hollow tubular member upon which a paper product 14 can be wound in a spiral fashion for later dispensing. "Paper product" as used herein refers to a cellulosic base product wound onto core 20, and can include but not be limited to facial or toilet tissue, or paper toweling. A "roll" as used herein refers to the combination of the core 20 and the paper product 14 wound on the core 20. The roll 12 can include a wrapping 16 to maintain the roll 12 in a generally flattened configuration illustrated in FIG. 1 until the roll 12 is ready for use.

During use roll 12 is typically supported on a spindle (not shown) for dispensing of the paper product 14. The spindle extends through the hollow core 20 and rotatably supports the roll 12. It is desirable that the hollow core 20 have a generally cylindrical configuration and circular cross-section when supported on the spindle to provide smooth, quiet dispensing.

Figure 2:
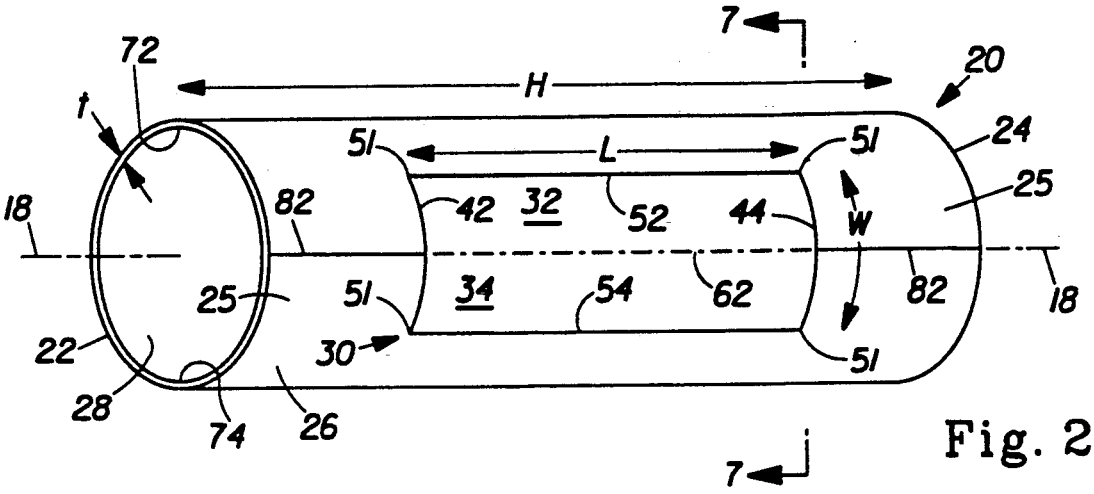
FIG. 2 is a perspective view of a core according to the present invention wherein the core is in a generally rerounded configuration and has a folding tab portion unfolded to form a generally circular arc conforming to the core inner and outer surfaces.
Figure 4:
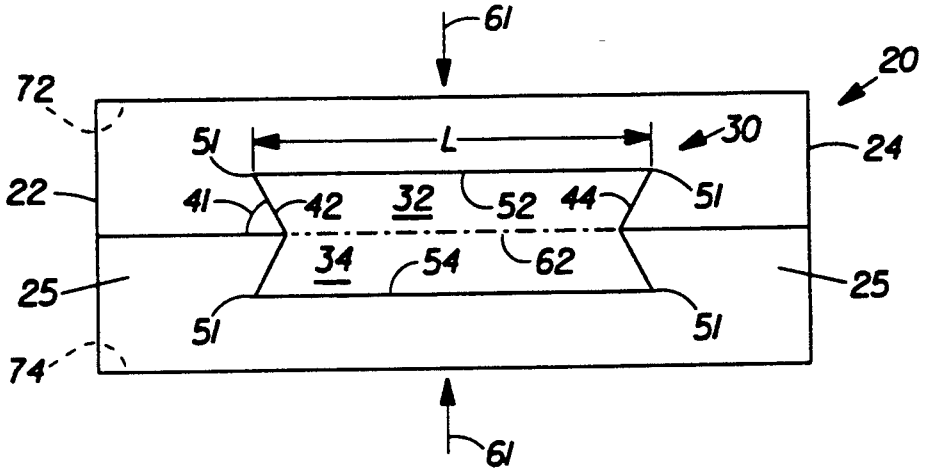
FIG. 4 is a side view of a core similar to that of FIG. 2, but with a folding tab portion having concave free edges.
Figure 5:
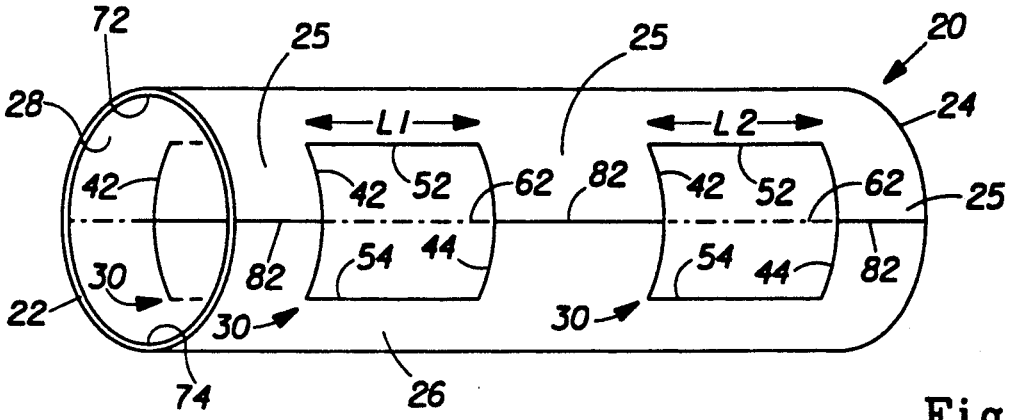
FIG. 5 is a perspective view of a core having two longitudinally spaced apart folding tab portions at a given core circumferential position.
Figure 6:
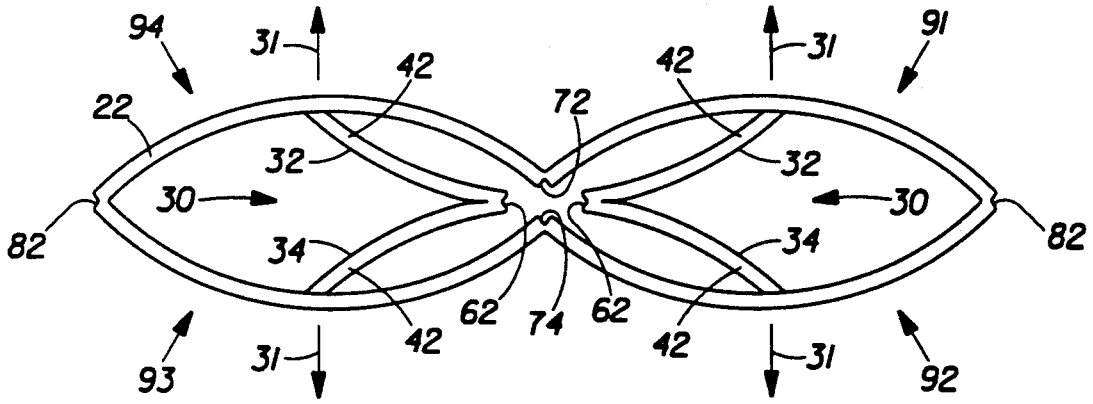
FIG. 6 is an end view of a core according to the present invention where the core is in a generally flattened configuration and the folding tab portions are folded radially inward.

The core 20 according to the present invention is shown in a generally cylindrical configuration in FIGS. 2 through 5, and in a generally flattened configuration in FIG. 6. As illustrated in FIG. 2, the core 20 has a longitudinal length H and a core axis 18 defined by the centers of two oppositely disposed, longitudinally spaced apart core ends 22 and 24. The core 20 has an outer surface 26 with an outer circumference and an inner surface 28 with an inner circumference, the surfaces 26 and 28 being separated by a core wall thickness t.

When toilet tissue is wound on core 20, the resulting roll 12 of toilet tissue typically has a diameter of about 10.2 cm to 12.7 cm (4.0 to 5.0 in.) and a length H of about 11.4 cm (4.5 in.). The core 20 may be made of a variety of materials including but not limited to paper, plastics, rubbers, or composite laminates.

The core 20 should have a mullen strength of at least 60 and preferably at least 70 as measured according to ASTM Test Method D2529. The core 20 preferably has a thickness t of at least about 0.5 mm (0.020 in.).

Regardless of the material used to make the core 20, the core 20 should have a longitudinal Taber stiffness of at least 40 Taber Stiffness Units (gram-centimeters) and preferably at least 75 Taber Stiffness Units (gram-centimeters) as measured with a stiffness tester according to TAPPI Standard T489 OM-86, with the following equipment and test procedure. A Teledyne Taber V-5 Stiffness Tester, Model 150-B can be used, such as is commercially available from Testing Machines Inc., Amityville, N.Y. Test Samples are cut from a core 20 to have a sample length of 6.98 centimeters (2.75 inches) as measured along the longitudinal axis of the core 20 and a sample width of 3.81 centimeters (1.5 inches) as measured around the circumference of the core 20. The core 20 should be free of wrinkles, tears, or creases. The curvature of the samples cut from the core 20 should be reduced prior to testing so that when the sample is placed on a flat surface, the sample has an arc extending no more than about 0.159 centimeters (0.0625 inches) above the flat surface. The curvature of the sample can be reduced by holding a straight edge along the length of the sample and gently applying a force along the length of the sample to reverse the curvature of the sample. This procedure can be repeated at spaced apart intervals of between about 0.32 centimeters and 0.64 centimeters across the width of the sample. The reduced curvature samples are then clamped widthwise in the stiffness tester so that the stiffness along the length dimension of the sample is measured. The Model 150-B stiffness tester is set to a test range of 50–500, with a test length of 5 centimeters, rollers mounted down, and a range weight of 500 units. TAPPI Standard T489 OM-86 states that sample stiffness should be measured in both a machine direction and cross-machine direction. The range of stiffness listed above refers only to stiffness measured along the length dimension of the sample.

A core 20 made of paper can be made of two spirally wrapped plies of a paper having any suitable combination of bleached krafts, sulfites, hardwoods, softwoods, and recycled fibers. Preferably, the paper is not calendered, so that it is relatively stiff and retains adhesive deposited thereon.

The core 20 may be made of paper having a basis weight of about 0.16 kg/square meter (0.032 lb/sq. ft.) and a ring crush strength of at least 6.79 kg/cm (38 lb/in.) and preferably at least 8.93 kg/cm (50 lb/in.) as measured according to TAPPI Standard T818 OM-87.

The core 20 of the present invention is selectively weakened by a series of cuts and score lines, perforations, or creases that permit the core 20 to be compressed to a generally flattened configuration and rerounded to a generally cylindrical configuration. The cuts and scores, perforations, creases, or folds can be selectively positioned to promote core 20 rerounding rather than core 20 inversion, prevent reflattening once the core 20 is rerounded, and provide a circular rather than polygonal core cross-section upon rerounding.

As used herein, a "cut" refers to removal or severance of core 20 material which removal or severance extends through the core 20 wall thickness t. As used herein, "score line" refers to a continuous line defined by material removed, partially severed, or absent from one of the surfaces 26, 28 of the core 20. A score line preferably penetrates between 25 percent to about 50 percent of the core wall thickness t. For instance, a score line can extend through one ply of a two ply core 20. The score lines may be made by a knife, scoring rule, or a rotary die. As used herein, "perforations" refers to a discontinuous series of discrete cuts, holes, or short score lines, where adjacent cuts, holes, or short score lines are spaced apart by lands having at least a fraction of the full core 20 wall thickness t. As used herein, a "crease" includes a continuous line of compression or densification of the core 20 material, or a line of folding of the wall of the core 20.

Figure 3:
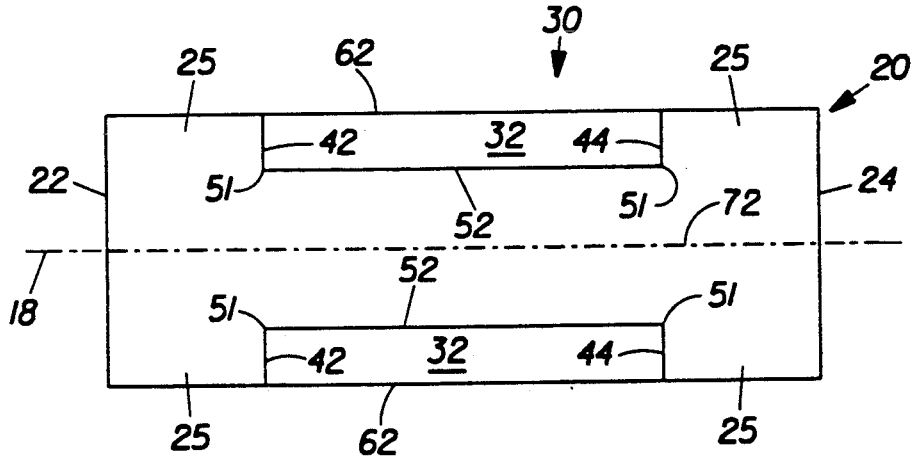
FIG. 3 is a top view of the core of FIG. 2 illustrating two diametrically opposed folding tab portions, and a longitudinally extending score line on the core inner surface spaced 90 degrees from the folding tab portions.

The core 20 according to the present invention is provided with at least one folding tab portion 30. FIGS. 2–4 illustrate a core 20 having one folding tab portion 30 at a given circumferential position, wherein the folding tab portion 30 is circumferentially aligned with core side panels 25. The folding tab portion 30 is longitudinally spaced from core ends 22 and 24 by core side panels 25. FIG. 5 illustrates a core 20 having two longitudinally spaced apart folding tab portions 30 at a given circumferential position on the core 20 circumference. Each of the folding tab portions 30 in FIG. 5 is positioned between longitudinally spaced apart core side panels 25.

The folding tab portions 30 can be folded radially inward to facilitate flattening of the core 20 to a generally flattened configuration, as shown in FIG. 6. The folding tab portions 30 are unfolded to form a circular arc conforming to the core surfaces 26 and 28 when the core 20 is rerounded. In this unfolded position, the folding tab portions 30 provide a generally circular inner core surface 28 and a generally cylindrical rerounded core configuration illustrated in FIGS. 2 through 5.

Each folding tab portion 30 has longitudinally spaced apart first and second free edges 42 and 44. Each folding tab portion 30 also has first and second selectively weakened attachments to the core 20 , indicated at 52 and 54 in FIG. 2. The first and second selectively weakened attachments 52 and 54 are circumferentially spaced apart, and extend intermediate the first and second free edges 42 and 44 to terminate at ends 51. A folding hinge 62 can be positioned intermediate the first and second selectively weakened attachments 52 and 54 to extend intermediate the first and second free edges 42, 44. The folding hinge line 62 is preferably positioned circumferentially equidistant from the selectively weakened attachments 52 and 54. Each folding tab portion 30 can have two circular arc panels 32 and 34 pivotably connected by the folding hinge 62.

Figure 7:
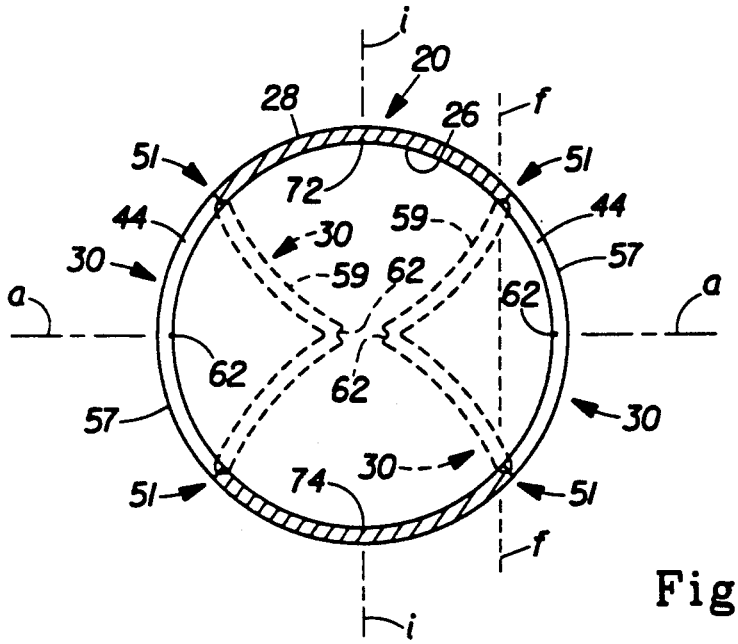
FIG. 7 is an instant sectional view taken along lines 7—7 of FIG. 1, showing two stable folding tab portion configurations.

FIG. 7 illustrates the bistable nature of a folding tab portion 30. Each folding tab portion 30 is deformable to a first stable position indicated by reference numeral 57, wherein the folding tab portion 30 is unfolded to conform to the core surfaces 26 and 28. In the first stable position, the folding tab portion 30 extends radially outward of an imaginary axis f—f extending between two longitudinally aligned ends 51.

Each folding tab portion 30 is deformable to a second stable position wherein the folding tab portion 30 extends radially inward of the core surfaces 26 and 28 and wherein at least a portion of the folding tab portion 30 extends radially inward of the imaginary axis f—f. This second stable position is shown in phantom in FIG. 7, and is indicated by reference numeral 59.

Without being limited by theory, the core side panels 25 promote the two distinct stable positions 57 and 59 of the folding tab portion 30 shown in FIG. 7. The core side panels 25 cause the folding tab portions 30 to "snap" from the stable position 59 shown in phantom to the stable position 57 wherein the folding tab portions 30 are unfolded to conform to the surfaces 26 and 28 of core 20. Stated differently, the core side panels 25 provide a geometric constraint that promotes one of the two distinct stable positions, rather than a position intermediate the two distinct stable positions. Therefore, once the core 20 is rerounded and the folding tab portions 30 are deformed to unfold and conform to the core surfaces 26 and 28, the folding tab portions 30 will tend to remain in the stable position 57.

A plurality of folding tab portions 30 are preferably positioned symmetrically about the circumference of core 20 so that the panels 32 and 34 provide symmetrical rerounding forces when the core 20 is in the flattened configuration of FIG. 6. In the preferred embodiment shown in FIGS. 2 through 6, the core 20 can have a pair of substantially diametrically opposed folding tab portions 30, and a pair of substantially diametrically opposed means 72 and 74 for selectively weakening the core 20. The means 72 and 74 for selectively weakening the core 20 are spaced approximately 90 degrees from the folding hinges 62 of the folding tab portions 30, and preferably comprise score lines on the core inner surface 28. Score line 72 is shown as a dotted line in FIG. 3 to indicate that it is located on the inside surface 28 of the core 30.

By "substantially diametrically opposed" it is meant that two features are angularly positioned within 170 degrees to 190 degrees of each other, inclusive, are preferably within 175 degrees to 185 degrees of each other, inclusive, and more preferably are within 179 degrees to 181 degrees of each other, inclusive. By "substantially 90 degrees" it is meant that two features are angularly positioned within 80 degrees to 100 degrees of each other, inclusive, are preferably within 85 degrees to 95 degrees of each other, inclusive, and more preferably are within 89 degrees to 91 degrees of each other, inclusive.

Each score line 72, 74 can extend longitudinally from the first core end 22 to the second core end 24. The folding tab portions 30 and the pair of diametrically opposed inner score lines 72 and 74 facilitate folding of the core 30 to a flattened configuration having four generally circular segments The four generally circular segments are indicated at 91, 92, 93 and 94 in FIG. 6. These four circular segments preserve the circular cross-section of the core 20 and promote rerounding of a flattened core 20 to a generally circular cross-section, rather than to a polygonal cross-section. A circular cross-section provides preferred product dispensing in terms of smoothness of dispensing and quietness of dispensing.

Referring back to FIG. 1, the core 20 is preferably selectively cut and scored, perforated, or creased according to the teachings of the present invention prior to the paper product 14 being wound on the core 20. However, it is to be understood that creasing of the core 20 can take place at any time up to and including the time at which the roll 12 is flattened.

The roll 12, prior to flattening, can be oriented so that a pair of diametrically opposed tab portions 30 are aligned with axis a—a. Diametrically opposed compressive forces parallel to axis a—a and longitudinally aligned with folding tab portions 30 can be applied to the roll 12 to deform the folding tab portions 30 radially inward to the stable position 59 shown in phantom in FIG. 7 prior to flattening the core 20. Prophetically, suction or other forces can be applied within the core 20 to deform the folding tab portions 30 radially inward prior to flattening the core 20.

Diametrically opposed compressive forces parallel to axis i—i can then be applied to the roll 12 to compress the roll 12 to the generally flattened configuration shown in FIG. 1. The wrapping 16 can hold the roll 12 in the compressed configuration until the roll 12 is to be used.

Upon removing the wrapping 16 and rerounding the roll 12 with compressive forces along axis a—a, the consumer can insert a finger or other object into the core 20 to exert radially outward forces on the folding tab portions 30. Each of the folding tab portions 30 can thereby be deformed radially outward to the stable unfolded position 57 of FIG. 7 to form a circular arc on the rerounded core circumference. The unfolded folding tab portions 30 conform to the core 20 circumference to provide a generally cylindrical inner core surface 28 for smooth, quiet dispensing. The unfolded folding tab portions 30 also resist reflattening of the core 20 by providing a load path for bending stresses on the outer surface 26 of the core 20.

Under normal use the folding tab portions 30 and score lines 72, 74 need only function through one cycle of flattening and rerounding of core 20. Repeated flattening and rerounding of core 20 will progressively weaken the folding hinge 62 and the score lines 72, 74, and result in a core 20 that is less resistant to reflattening by diametrically opposed compressive forces. For a paper core 20 made according to the embodiments described herein, the folding tab portions 30 and score lines 72, 74 are able to function as described above for at least 3 to 4 cycles of flattening and rerounding of the core 20.

A core weakening means 82 can be provided and circumferentially aligned at or near each folding hinge 62, to permit flattening of the core 20 as shown in FIG. 6. The inwardly folded panels 32 and 34 can act as spring members in series when the core 20 is in the flattened configuration shown in FIG. 6. The panels 32 and 34 thereby provide outward biasing forces (illustrated by arrows 31) on the flattened core 20 to promote rerounding of the core 20 and resist inversion of the core 20 to a crescent shape.

The free edges 42 and 44 of folding tab portions 30 can be formed by circumferentially oriented cuts extending through the core wall thickness t, and can be longitudinally spaced from the core ends 22 and 24. The free edges 42, 44 are shown extending generally perpendicularly to core axis 18 in FIGS. 2 and 3. Alternatively, the free edges 42 and 44 can be angled with respect to the core axis 18. For example, in a preferred embodiment shown in FIG. 4, the free edges 42 and 44 are concave towards the ends 22 and 24 of the core 20. The concave free edges 42 and 44 can reduce "snagging" or "catching" of the spindle on the free edges 42 and 44 when the spindle is inserted into rerounded core 20. The concave free edges 42 and 44 shown in FIG. 4 can form an angle 41 with the longitudinal axis 18 between 20 degrees and 70 degrees, and preferably about 45 degrees.

If the core 20 includes one folding tab portion 30 at a given circumferential location, the free edges 42 and 44 are preferably equidistantly spaced from core ends 22 and 24, respectively, so that the folding tab portion 30 is centered along core longitudinal length H. If the core 20 includes more than one folding tab portion 30 at a given circumferential location, the two folding tab portions 30 nearest the core ends 22 and 24 can have a free edge 42 or 44 coincident with the core end 22 or 24. Alternatively, where the core 20 includes more than one folding tab portion 30 at a given circumferential location, the two folding tab portions 30 nearest the core ends 22 and 24 have free edges 42 and 44 longitudinally spaced from the core ends 22 and 24, as shown in FIG. 5.

The selectively weakened attachments 52 and 54 can comprise a longitudinally extending weakened line on the core 20, such as a longitudinally extending crease line or line of perforations. More preferably, the attachments 52 and 54 comprise score lines on the core outer surface 26. Preferably the score lines 52, 54 extend through between about 25 percent to about 50 percent of the thickness t of the core 20. The attachments 52 and 54 can comprise longitudinally extending straight score lines.

Each folding hinge 62 can be formed by selectively weakening the folding tab portion 30 intermediate the free edges 42 and 44. Each folding hinge 62 can comprise a crease line or a line of perforations. Preferably, each folding hinge 62 comprises a score line on an inner surface of the folding tab portion 30 extending intermediate the free edges 42 and 44. The score line forming the folding hinge 62 preferably extends through about 25 percent to about 50 percent of the wall thickness t of core 20. The folding hinge 62 inner score line is shown as a dashed line in FIGS. 2 through 5. The core weakening means 82 circumferentially aligned with each folding hinge 62 can comprise a score line on the core outer surface 26.

Inner scoring of the folding hinge 62 preserves a continuous load path on the outer surface of the folding tab portion 30. Once the core 20 is rerounded from the flattened configuration of FIG. 6, the load path provided by the outer surface of the folding tab portion 30 can carry bending stresses to resist reflattening of the core 20. For instance, opposed compressive forces 61 shown in FIG. 4 will cause circumferentially oriented tensile bending stresses on the outer surface of folding tab portion 30. Inner scoring of folding hinge 62 preserves a load path for these bending stresses when the folding tab portion 30 is unfolded as in FIGS. 2 through 5, while also permitting inward folding of the panels 32 and 34 as in FIG. 6.

Each of the folding tab portions 30 has a longitudinal length L less than the core 20 longitudinal length H, thereby leaving at least one core side panel 25 longitudinally adjacent each folding tab portion 30. Where two or more folding tab portions 30 are positioned at a given circumferential position, the aggregate longitudinal length of the folding tab portions 30 is less than the core 20 length H. For instance, in FIG. 5 the aggregate longitudinal length of the folding tab portions 30 at a given circumferential location is L1+L2, which is less than the core 20 length H. In FIG. 5, the core side panels 25 longitudinally space the folding tab portions 30 at a given circumferential portion from each other and from core ends 22 and 24. FIGS. 2–4 show a core with only one folding tab portion 30 at a given circumferential position. The folding tab portion 30 in FIGS. 2–4 has an aggregate longitudinal length equal to L, and is spaced from core ends 22 and 24 by core side panels 25.

The aggregate longitudinal length of the folding tab portions 30 at a given circumferential location should be less than the length H of core 20. A folding tab portion 30 extending the full length H could result in reflattening of a rerounded core 20 along selectively weakened attachments 52 and 54. Such reflattening could be caused by opposed compressive loads such as those shown at arrows 61 in FIG. 4.

Further, the stiffness of the core side panels 25 decreases as the aggregate longitudinal length of the folding tab portion 30 at a given circumferential location is increased. As a result, the core side panels 25 may buckle when the folding tab portions 30 are deformed radially inward, or fail to promote the two stable positions 57 and 59 shown in FIG. 7 if folding tab portion 30 aggregate longitudinal length is nearly equal to length H of core 20. Conversely, the aggregate length of the folding hinges 62 at a given circumferential location should be adequate to carry bending stresses to resist reflattening of the core, as discussed above. For the paper cores 20 described herein, the aggregate longitudinal length of the folding tab portions 30 at a given circumferential location is preferably between $\frac{1}{4}$ and $\frac{3}{4}$ of the length H of the core 20. For example, the aggregate longitudinal length can be equal to about $\frac{1}{2}$ the length H.

Referring back to FIG. 2, the folding tab portions 30 have a circumferential width W. The width W affects the location of the line of action of outward rerounding forces 31 generated by panels 32 and 34 when the core 20 is in the generally flattened configuration of FIG. 6. It is desirable that the line of action of forces 31 be located near the center of core 20 for maximum mechanical advantage in resisting core inversion. The line of action of forces 31 moves toward the center of core 20 as the width W is increased to as much as $\frac{1}{2}$ of the rounded core 20 outer circumference.

The available width W for each folding tab portion 30 decreases as the number of folding tab portions 30 on the core circumference increases. Also, width W should not be so large that opposite folding tab portions 30 interfere with one another when the core 20 is in the generally flattened configuration of FIG. 6. For a core 20 having two diametrically opposed folding tab portions 30, the width W of each folding tab portion 30 can equal approximately $\frac{1}{4}$ of the rounded core 20 outer circumference without causing such interference. Alternatively, by longitudinally staggering diametrically opposed folding tab portions 30, the width W can be increased to as much as $\frac{1}{2}$ of the rounded core 20 outer circumference without causing interference between the folding tab 30 and other portions of the core 20.

Prophetically, a core 20 according to the present invention can be made from two spirally wrapped and adhesively bonded plies of a paper formed from a combination of bleached krafts, sulfites, hardwoods, softwoods, and recycled fibers. The paper forming the two spirally wrapped plies can have a basis weight of 0.16 kilograms per square meter (0.032 pounds per square foot). The core 20 can have a wall thickness t of 0.5 millimeter (0.020 inch), an inside diameter of 41.2 millimeter (1.625 inch), and a length H of 11.4 centimeters (4.5 inch).

The core 20 can have two substantially diametrically opposed folding tab portions 30, each folding tab portion 30 having a length L equal to 5.7 centimeters (2.25 inch) and a width W equal to 33.1 millimeter (1.3 inch). Each folding tab portion 30 can be centered longitudinally along the core length H and include two circumferentially extending free edges 42, 44 spaced longitudinally from the core ends 22 and 24. The folding tab portion 30 selectively weakened attachments 52, 54 to the core 20 can comprise two straight longitudinal score lines on the core outer surface 26 extending between the two free edges 42, 44. The folding tab hinge 62 can comprise a straight longitudinal score line on the folding tab inner surface extending between the two free edges 42, 44. The folding hinge 62 can be positioned circumferentially equidistant from the two selectively weakened attachments 52, 54 to the core 20 to pivotably connect two circular arc folding tab panels 32, 34.

Additionally, the core 20 can include two substantially diametrically opposed longitudinal score lines 72, 74 on the core 20 inner surface. The score lines 72, 74 can extend between the core ends 22, 24 and be positioned substantially ninety degrees from the folding hinges 62 of the diametrically opposed folding tab portions 30.

While particular embodiments of the present invention have been illustrated and described, various changes and modifications can be made to the present invention without departing from the spirit and scope of the invention. It is therefore intended to cover in the appended claims all such changes and modifications that are within the scope of the invention.

What is claimed is:

1. A core about which a paper product may be wound, the core being deformable from a generally cylindrical configuration to a generally flattened configuration, the core comprising:

an inner surface and an outer surface separated by a core wall having a finite thickness;

first and second longitudinally spaced apart core ends defining a longitudinal core axis and a core length;

at least one folding tab portion for selectively weakening the core disposed at a given circumferential position and having an aggregate longitudinal length less than the core length, each folding tab portion being foldable to extend radially inward of the core surfaces when the core is in the generally flattened configuration, each folding tab portion being generally conformable to the core inner and outer surfaces when the core is in the generally cylindrical configuration, each folding tab portion comprising:

longitudinally spaced apart first and second free edges, at least one of the free edges spaced from the core ends;

a first selectively weakened attachment to the core extending intermediate the first and second free edges; and a second selectively weakened attachment to the core circumferentially spaced from the first selectively weakened attachment and extending intermediate the first and second free edges.

2. The core recited in claim 1 wherein in the first and second free edges are formed by circumferentially oriented cuts extending through the core wall thickness.

3. The core recited in claim 1 wherein each folding tab portion further comprises a folding hinge intermediate the first and second selectively weakened attachments to the core, the folding hinge extending intermediate the first and second free edges.

4. The core recited in claim 3 comprising a plurality of folding tab portions generally symmetrically disposed about a core circumference.

5. The core recited in claim 4 comprising two substantially diametrically opposed folding tab portions.

6. The core recited in claim 3 comprising:

a pair of substantially diametrically opposed folding tab portions; and a pair of substantially diametrically opposed means for selectively weakening the core, the means for selectively weakening the core spaced substantially 90 degrees from the folding tab portion folding hinges.

7. The core recited in claim 3 wherein the folding tab portion first and second selectively weakened attachments to the core comprise longitudinally extending score lines on the core outer surface.

8. The core recited in claim 3 wherein the folding tab portions disposed at a given circumferential location have an aggregate longitudinal length between $\frac{1}{4}$ the core length and $\frac{3}{4}$ the core length.

9. The core recited in claim 8 wherein the folding tab portions disposed at a given circumferential location have an aggregate longitudinal length approximately equal to $\frac{1}{2}$ the core length.

10. The core recited in claim 7 wherein the folding hinge comprises a longitudinally extending score line on a folding tab portion inner surface.

11. The core recited in claim 3 wherein each folding tab portion comprises a first generally circular arc panel pivotably connected to a second generally circular arc panel at the folding hinge line.

12. The core recited in claim 3 wherein at least one folding tab portion has a concave free edge.

13. A core about which a paper product may be wound, the core being deformable from a generally cylindrical configuration to a generally flattened configuration, the core comprising:

an inner surface and an outer surface separated by a core wall having a finite thickness;

first and second longitudinally spaced apart core ends defining a longitudinal core axis and a core length;

at least one folding tab portion for selectively weakening the core disposed at a given circumferential location and having an aggregate longitudinal length less than the core length, each folding tab portion being foldable to extend radially inward of the core surfaces when the core is in the generally flattened configuration, each folding tab portion being generally conformable to the core inner and outer surfaces when the core is in the generally cylindrical configuration, each folding tab portion comprising:

longitudinally spaced apart first and second free edges formed by circumferentially oriented cuts through the core, the first and second free edges spaced longitudinally inward from the core ends;

a first selectively weakened attachment to the core extending intermediate the first and second edges;

a second selectively weakened attachment to the core circumferentially spaced from the first selectively weakened attachment and extending intermediate the first and second free edges; and a folding hinge intermediate the first and second selectively weakened attachments to the core and extending intermediate the first and second free edges.

14. The core recited in claim 13 comprising:

a pair of substantially diametrically opposed folding tab portions; and a pair of substantially diametrically opposed, longitudinally extending means for selectively weakening the core, the means for selectively weakening the core extending substantially from the first core end to the second core end and spaced substantially 90 degrees from the folding tab portion folding hinges.

15. The core recited in claim 14 wherein each folding hinge comprises a longitudinally extending score line on a folding tab portion inner surface, and wherein the pair of substantially diametrically opposed means for selectively weakening the core comprise score lines on the inner core surface, each score line extending substantially from the first core end to the second core end.

16. The core recited in claim 15 further comprising a core weakening means circumferentially aligned with each folding tab portion folding hinge line.

17. The core recited in claim 16 wherein the core weakening means circumferentially aligned with each folding tab portion folding hinge line comprises a score line on the core outer surface.

18. The core recited in claim 13 wherein at least one folding tab portion has a concave free edge.

* * * * *

UNITED STATES PATENT AND TRADEMARK OFFICE

CERTIFICATE OF CORRECTION

PATENT NO. : 5,318,235

DATED : JUNE 7, 1994

INVENTOR(S) : JAY K. SATO

It is certified that error appears in the above-identified patent and that said Letters Patent is hereby corrected as shown below:

Column 1, line 12 delete "Care" and insert therefor --Core--.

Signed and Sealed this

Eighth Day of November, 1994

*Attest:*

*Attesting Officer*

BRUCE LEHMAN

*Commissioner of Patents and Trademarks*